US010969708B2

(12) United States Patent
Suganuma et al.

(10) Patent No.: US 10,969,708 B2
(45) Date of Patent: Apr. 6, 2021

(54) DEVELOPING DEVICE, PROCESS CARTRIDGE, AND IMAGE FORMING APPARATUS

(71) Applicants: Takuya Suganuma, Kanagawa (JP); Tatsuya Kubo, Kanagawa (JP)

(72) Inventors: Takuya Suganuma, Kanagawa (JP); Tatsuya Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/804,812

(22) Filed: Feb. 28, 2020

(65) Prior Publication Data

US 2020/0301313 A1 Sep. 24, 2020

(30) Foreign Application Priority Data

Mar. 18, 2019 (JP) ..... JP2019-049424

(51) Int. Cl.
*G03G 15/08* (2006.01)
*G03G 15/09* (2006.01)

(52) U.S. Cl.
CPC ..... *G03G 15/0815* (2013.01); *G03G 15/0921* (2013.01); *G03G 15/0942* (2013.01)

(58) Field of Classification Search
CPC ..... G03G 15/0815; G03G 15/0921; G03G 15/0942
See application file for complete search history.

(56) References Cited

U.S. PATENT DOCUMENTS

2003/0099481 A1 5/2003 Sampe et al.
2003/0219276 A1* 11/2003 Sato ..... G03G 15/0815 399/103

(Continued)

FOREIGN PATENT DOCUMENTS

JP 2003-162151 6/2003
JP 2003-337476 11/2003

(Continued)

OTHER PUBLICATIONS

Machine Translation of JP2016-109950. Jun. 20, 2016. (Year: 2016).*

(Continued)

*Primary Examiner* — Carla J Therrien
(74) *Attorney, Agent, or Firm* — Harness, Dickey and Pierce, P.L.C.

(57) ABSTRACT

A developing device includes a developing roller to rotate in a predetermined direction of rotation and opposed to or in contact with an image bearer to form a development range, a cover to cover the developing roller downstream from the development range in the predetermined direction of rotation, a sheet member cantilevered by the cover to contact the developing roller with a flat face of the sheet member while trailing along the predetermined direction of rotation at a position downstream from the development range. The cover includes a large gap portion to form a first gap in a first predetermined range in the predetermined direction of rotation and a small gap portion disposed adjacent to and downstream from the large gap portion in the predetermined direction of rotation to form a second gap smaller than the first gap in a second predetermined range in the predetermined direction of rotation.

13 Claims, 5 Drawing Sheets

(56) References Cited

U.S. PATENT DOCUMENTS

| | | | | |
|---|---|---|---|---|
| 2005/0141915 | A1* | 6/2005 | Okamoto | G03G 15/0896 399/103 |
| 2008/0080906 | A1* | 4/2008 | Kawahara | G03G 15/0942 399/277 |
| 2010/0098463 | A1* | 4/2010 | Matsumoto | G03G 15/0921 399/254 |
| 2011/0311263 | A1* | 12/2011 | Mizuta | G03G 15/0815 399/98 |
| 2016/0170329 | A1 | 6/2016 | Kimura et al. | |
| 2017/0038704 | A1* | 2/2017 | Makita | G03G 15/0812 |
| 2017/0363987 | A1 | 12/2017 | Nodera et al. | |
| 2018/0120737 | A1 | 5/2018 | Okamoto et al. | |
| 2018/0348698 | A1 | 12/2018 | Tamaki et al. | |
| 2019/0064699 | A1 | 2/2019 | Nodera et al. | |
| 2020/0033752 | A1 | 1/2020 | Kubo et al. | |

FOREIGN PATENT DOCUMENTS

| | | |
|---|---|---|
| JP | 2016-035545 | 3/2016 |
| JP | 2016-109950 A | 6/2016 |
| JP | 2016-139111 | 8/2016 |

OTHER PUBLICATIONS

Extended European Search Report dated Aug. 26, 2020 issued in corresponding European Appln. No. 20161592.9.

* cited by examiner

DEVELOPING DEVICE, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-049424, filed on Mar. 18, 2019, in the Japan Patent Office, the entire disclosure of which is hereby incorporated by reference herein.

BACKGROUND

Technical Field

Embodiments of the present disclosure generally relate to a developing device configured to develop a latent image formed on a surface of an image bearer, a process cartridge incorporating the developing device, and an electrophotographic image forming apparatus, such as a copier, a printer, a facsimile machine, or a multifunction peripheral (MFP) having at least two of such capabilities.

Description of the Related Art

In image forming apparatuses such as copiers, printers, facsimile machines, and MFPs, developing devices are widely used that contain a two-component developer including toner and carrier and include a cover (e.g., a housing or a development casing) to cover a developing roller downstream from a development range.

SUMMARY

Embodiments of the present disclosure describe an improved developing device configured to develop latent images formed on a surface of an image bearer. The developing device includes a developing roller configured to rotate in a predetermined direction of rotation and opposed to or in contact with the image bearer to form a development range, a cover configured to cover the developing roller downstream from the development range in the predetermined direction of rotation, a sheet member cantilevered by the cover and configured to contact the developing roller with a flat face of the sheet member while trailing along the predetermined direction of rotation at a position downstream from the development range. The cover includes a large gap portion to form a first gap between the large gap portion and the developing roller in a first predetermined range in the predetermined direction of rotation and a small gap portion disposed adjacent to and downstream from the large gap portion in the predetermined direction of rotation to form a second gap smaller than the first gap between the small gap portion and the developing roller in a second predetermined range in the predetermined direction of rotation.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
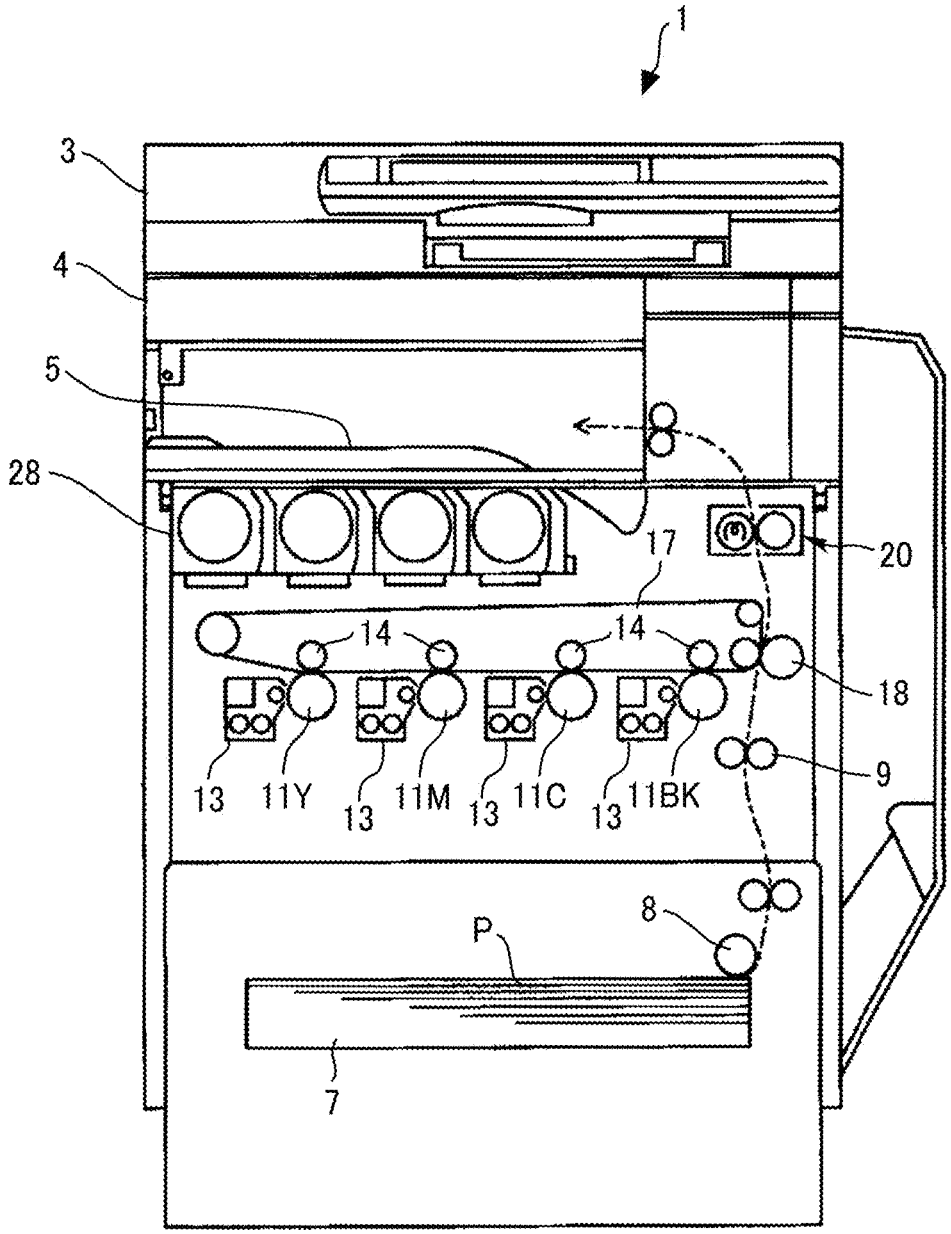
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. It is to be understood that identical or similar reference numerals are assigned to identical or corresponding components throughout the drawings, and redundant descriptions are omitted or simplified below as required.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

A configuration and operation of an image forming apparatus 1 is described below with reference to FIG. 1.

In FIG. 1, the image forming apparatus 1, which is a tandem color copier in the present embodiment, includes a document conveyance device 3, a scanner (document reading device) 4, an output tray 5, a sheet feeding device 7, and a registration roller pair 9. The document conveyance device 3 feeds a document to the scanner 4. The scanner 4 scans image data for the document. The sheet feeding device 7 contains sheets P such as paper sheets. The registration roller pair (timing roller pair) 9 adjusts the timing of conveyance of the sheet P. Output images are stacked on the output tray 5.

The image forming apparatus 1 also includes photoconductor drums 11Y, 11M, 11C, and 11BK as image bearers, developing devices 13, primary transfer rollers 14, and an intermediate transfer belt 17 as an intermediate transferor. Electrostatic latent images are formed on surfaces of the photoconductor drums 11Y, 11M, 11C, and 11BK and developed into toner images of yellow, magenta, cyan, and black by the developing devices 13. The toner images on the surfaces of the photoconductor drums 11Y, 11M, 11C, and 11BK (hereinafter, also collectively referred to as "photoconductor drums 11") are transferred to and superimposed on the intermediate transfer belt 17 by the primary transfer rollers 14, thereby forming a multicolor toner image on the intermediate transfer belt 17.

The image forming apparatus 1 further includes a secondary transfer roller 18, a fixing device 20, and toner containers 28. The secondary transfer roller 18 transfers the multicolor toner image on the intermediate transfer belt 17 onto the sheet P. The fixing device 20 fixes the multicolor toner image (unfixed image) on the sheet P. The toner containers 28 contain yellow, magenta, cyan, and black toners to supply the toners to the developing devices 13.

Figure 2:
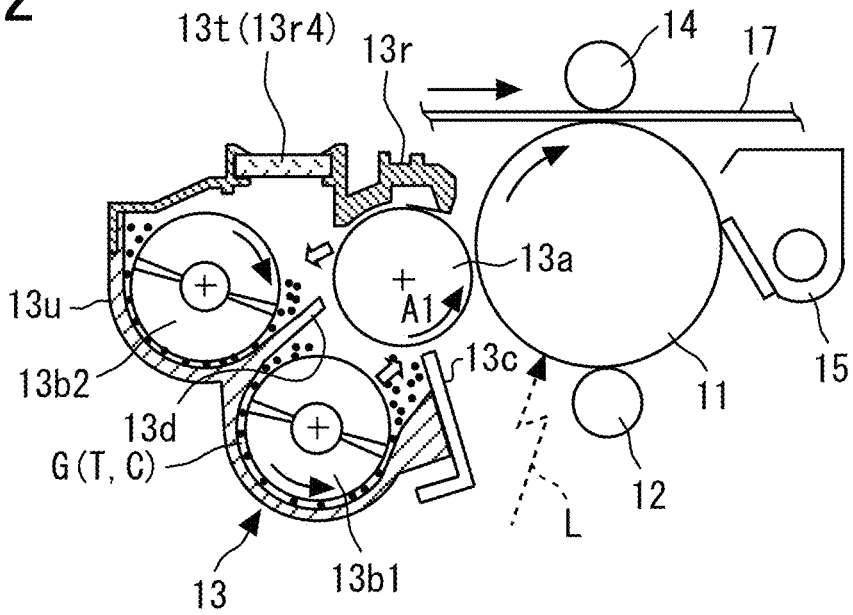
FIG. 2 is a schematic view illustrating a configuration of an image forming unit of the image forming apparatus in FIG. 1.

A description is provided below of the operation of the image forming apparatus 1 when forming a normal color image with continued reference to FIG. 1 as well as FIG. 2. FIG. 2 is a schematic view illustrating a configuration of an image forming unit of the image forming apparatus 1 in FIG. 1.

A conveyance roller of the document conveyance device 3 transports a document on a document table onto a platen (exposure glass) of the scanner 4. Then, the scanner 4 optically scans image data for the document on the platen.

More specifically, the scanner 4 scans an image of the document on the platen with light emitted from an illumination lamp. The light reflected from a surface of the document is directed onto a color sensor via mirrors and lenses to form multicolor image data. The multicolor image data for the document, which is decomposed into red, green, and blue (RGB) data, is read by the color sensor and converted into electrical image signals. Further, an image processor performs image processing (e.g., color conversion, color calibration, and spatial frequency adjustment) according to the image signals of the decomposed RGB data, and thus image data for yellow, magenta, cyan, and black toner images are obtained.

The image data for yellow, magenta, cyan, and black toner images are transmitted to a writing device. The writing device directs a laser beam L (see FIG. 2) onto a surface of the corresponding photoconductor drum 11 according to the image data for each color.

Meanwhile, the four photoconductor drums 11 rotate clockwise as illustrated in FIGS. 1 and 2. Initially, the surface of each photoconductor drum 11 is uniformly charged by a charging device 12 (see FIG. 2) at a position facing each other (charging process). Thus, the surface of the photoconductor drum 11 is charged to a certain potential. Subsequently, the charged surface of the photoconductor drum 11 reaches a position where the surface is scanned by the laser beam L.

The writing device emits the laser beam L from each of four light sources according to the image data. The respective laser beams L pass through different optical paths for the different components of yellow, magenta, cyan, and black (exposure process).

The laser beam L corresponding to the yellow component is directed onto the surface of the photoconductor drum 11Y that is the first from the left in FIG. 1 among the four photoconductor drums 11Y, 11M, 11C, and 11BK. A polygon mirror that rotates at high velocity deflects the laser beam L for yellow along the axis of rotation of the photoconductor drum 11 (i.e., the main-scanning direction) so that the laser beam L scans the surface of the photoconductor drum 11. Thus, an electrostatic latent image for yellow is formed on the surface of the photoconductor drum 11Y charged by the charging device 12.

Similarly, the laser beam L corresponding to the magenta component is directed onto the surface of the photoconductor drum 11M that is the second from the left in FIG. 1, thus forming an electrostatic latent image for magenta thereon. The laser beam L corresponding to the cyan component is directed onto the surface of the photoconductor drum 11C that is the third from the left in FIG. 1, thus forming an electrostatic latent image for cyan thereon. The laser beam L corresponding to the black component is directed onto the surface of the photoconductor drum 11BK that is the fourth from the left in FIG. 1, thus forming an electrostatic latent image for black thereon.

Then, the surface of the photoconductor drum 11 having the electrostatic latent image reaches a position opposite the developing device 13. The developing device 13 deposits toner of each color onto the photoconductor drum 11 and develops the electrostatic latent image on the surface of the photoconductor drum 11 into a visible toner image (development process).

After the development process, the surfaces of the photoconductor drums 11 reach positions facing the intermediate transfer belt 17. The primary transfer rollers 14 are disposed at positions where the photoconductor drums 11 face the intermediate transfer belt 17 and in contact with an inner surface of the intermediate transfer belt 17, respectively. At the positions of the primary transfer rollers 14, the toner images on the photoconductor drums 11Y, 11M, 11C, and 11BK are transferred to and superimposed on the intermediate transfer belt 17, thereby forming a multicolor toner image thereon (primary transfer process).

After the primary transfer process, the surface of the photoconductor drum 11 reaches a position opposite a cleaning device 15. The cleaning device 15 collects untransferred toner remaining on the surface of the photoconductor drum 11 (cleaning process).

Then, the surface of the photoconductor drum 11 passes through a discharge device to complete a series of image forming processes performed on the photoconductor drum 11.

The multicolor toner image is formed on a surface of the intermediate transfer belt 17 by transferring and superimposing the respective single-color toner images formed on the photoconductor drums 11. Then, the intermediate transfer belt 17 carrying the multicolor toner image moves counterclockwise in FIG. 1 to reach a position opposite the secondary transfer roller 18. The secondary transfer roller 18 secondarily transfers the multicolor toner image carried on the intermediate transfer belt 17 onto the sheet P at the position between the secondary transfer roller 18 and the intermediate transfer belt 17 (secondary transfer process).

After the secondary transfer process, the surface of the intermediate transfer belt 17 reaches a position opposite a belt cleaning device. The belt cleaning device collects untransferred toner adhering to the intermediate transfer belt 17 to complete a sequence of transfer processes performed on the intermediate transfer belt 17.

The sheet P is transported from the sheet feeding device 7 via the registration roller pair 9 to a secondary transfer nip between the intermediate transfer belt 17 and the secondary transfer roller 18.

More specifically, a sheet feeding roller 8 feeds the sheet P from the sheet feeding device 7 that contains a stack of sheets P, and the sheet P is then guided by a sheet guide to the registration roller pair 9. The sheet P that has reached the registration roller pair 9 is transported toward the secondary transfer nip, timed to coincide with the arrival of the multicolor toner image on the intermediate transfer belt 17.

Then, the sheet P carrying the multicolor toner image is transported to a fixing device 20. The fixing device 20 includes a fixing roller and a pressure roller pressing against each other. In a nip between the fixing roller and the pressure roller, the multicolor toner image is fixed on the sheet P.

After the fixing process, an output roller pair ejects the sheet P as an output image outside the image forming apparatus 1, and the ejected sheet P is stacked on the output tray 5. Thus, a series of the image forming processes is completed.

Next, an image forming unit of the image forming apparatus 1 is described in further detail below with reference to FIGS. 2 to 5.

Figure 3:
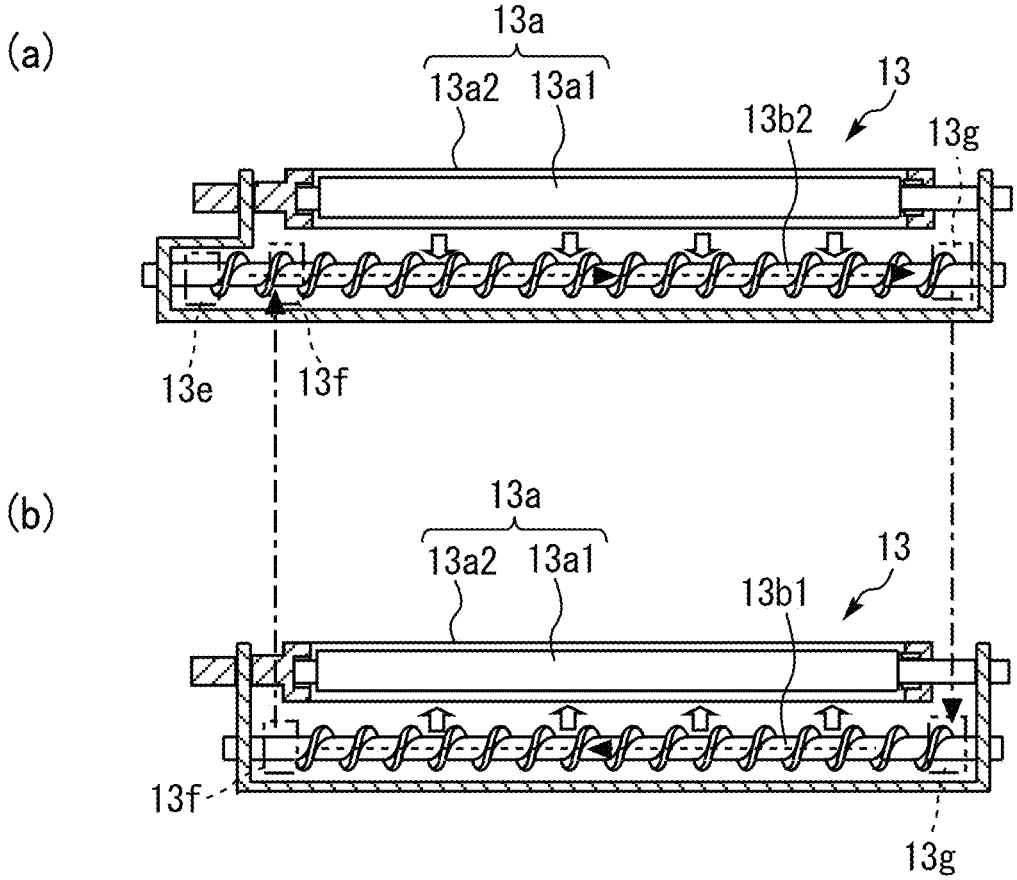
FIG. 3 is a schematic longitudinal cross-sectional view of a developing device of the image forming unit in FIG. 2.
Figure 4:
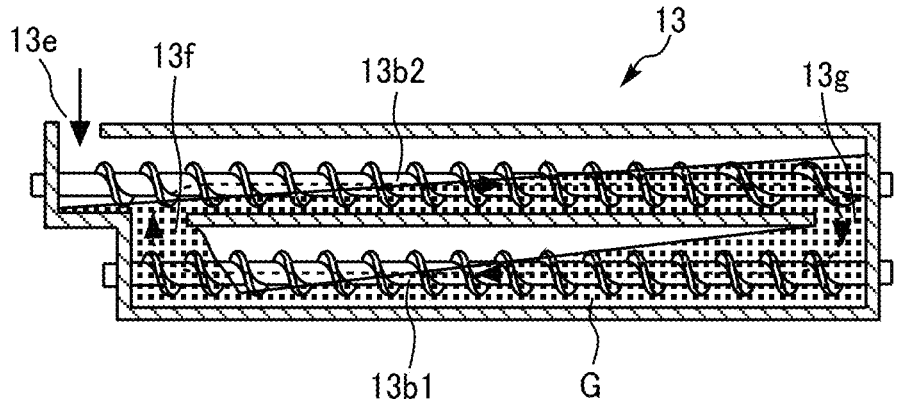
FIG. 4 is a schematic longitudinal cross-sectional view illustrating a circulation path of the developing device in FIG. 3.
Figure 5:
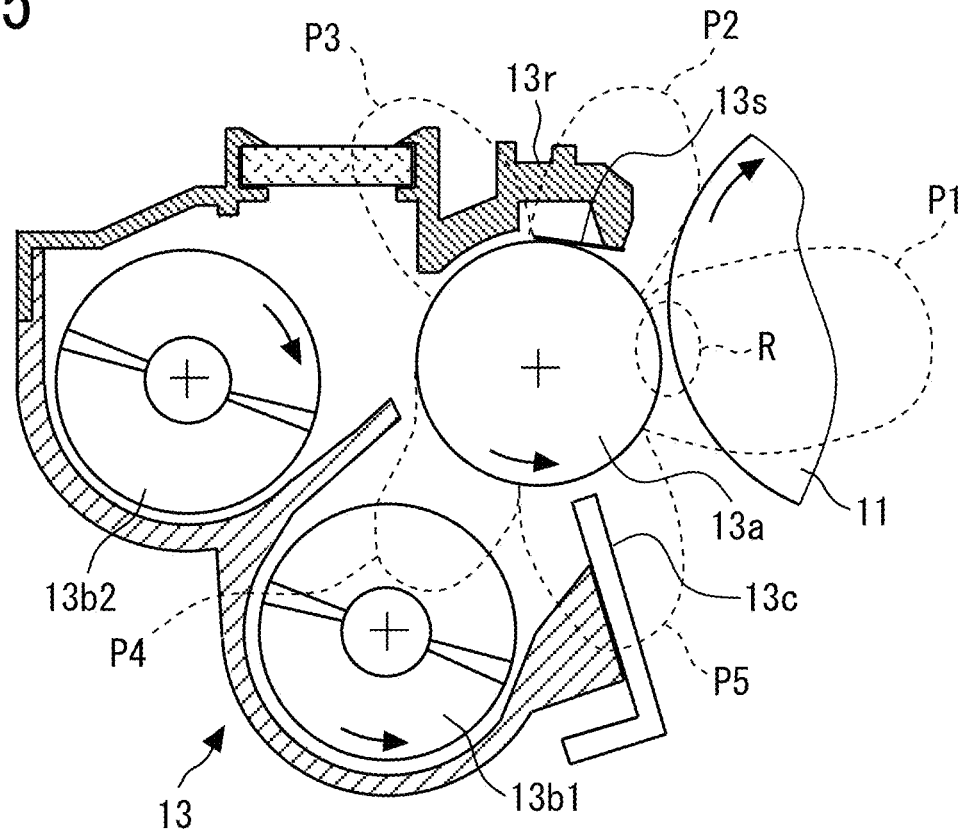
FIG. 5 is a cross-sectional view illustrating distribution of magnetic force generated around a developing roller of the developing device.

FIG. 2 is a schematic view illustrating a configuration of the image forming unit. A part (a) of FIG. 3 is a horizontal schematic cross-sectional view of an upper portion of the developing device 13 as viewed along a longitudinal direction of the developing device 13. In the part (a) of FIG. 3, a second conveying screw **13*b*2 as a conveyor for collecting the developer is disposed in a collection path of the upper portion. A part (b) of FIG. 3 is a schematic cross-sectional view of a lower portion of developing device 13 as viewed along the longitudinal direction of the developing device 13. In the part (b) of FIG. 3, a first conveying screw 13*b*1 as a conveyor for supplying the developer is disposed in a supply path of the lower portion. FIG. 4 is a vertical schematic cross-sectional view illustrating a circulation path of the developer in the developing device 13 as viewed along the longitudinal direction of the developing device 13. FIG. 5 is a cross-sectional view illustrating distribution of magnetic force generated around a developing roller 13*a* of the developing device 13**.

It is to be noted that the suffixes Y, M, C, and BK of components of the image forming units, such as the photoconductor drum 11, the developing device 13, and the like are omitted in FIGS. 2 to 5 for simplicity because the image forming units have a similar configuration.

As illustrated in FIG. 2, each image forming unit includes the photoconductor drum 11 as the image bearer, the charging device 12, the developing device 13, the cleaning device 15, and the like.

The photoconductor drum 11 as the image bearer in the present embodiment is a negatively-charged organic photoconductor and is rotated clockwise in FIG. 2 by a drive motor.

The charging device 12 is an elastic charging roller and can be formed by covering a core with an elastic layer of moderate resistivity, such as foamed urethane layer, that includes carbon black as conductive particles, sulfuration agent, foaming agent, and the like. The material of the elastic layer of moderate resistivity of the charging device 12 includes, but not limited to, rubber such as urethane, ethylene-propylene-diene-polyethylene (EPDM), acrylonitrile butadiene rubber (NBR), silicone rubber, and isoprene rubber to which conductive material such as carbon black or metal oxide is added to adjust the resistivity. Alternatively, foamed rubber including these materials may be used.

The cleaning device 15 includes a cleaning blade that slidingly contacts the surface of the photoconductor drum 11 and mechanically removes untransferred toner on the photoconductor drum 11.

The developing device 13 includes a developing roller **13*a*, serving as a developer bearer, opposed to the photoconductor drum 11 across a slight gap. A development range R (see FIG. 5) where a magnetic brush formed on the developing roller 13*a* contacts the photoconductor drum 11 is formed in a portion where the developing roller 13*a* is opposed to the photoconductor drum 11. The developing device 13 contains a two-component developer G including toner T and carrier C. The developing device 13 develops the electrostatic latent image on the photoconductor drum 11 into the toner image. The configuration and operation of the developing device 13** are described in further detail later.

The toner containers 28 contain toner T to be supplied to the developing devices 13. Specifically, the developing device 13 includes a magnetic sensor to detect toner concentration (i.e., a ratio of toner T to the developer G). Depending on the toner concentration detected by the magnetic sensor, the toner T is supplied from the toner container 28 to the developing device 13 via a toner conveyance tube and a toner supply inlet **13*e* (see FIGS. 3 and 4**).

In the present embodiment, any toner can be used as the toner T in the developer G and the toner T in the toner container 28, and any carrier can be used as the carrier C in the developer G.

Next, the developing device 13 of the image forming apparatus 1 is described in further detail below.

With reference to FIGS. 2 to 5, it can be seen that the developing device 13 includes the developing roller **13*a* serving as a developer bearer, the first conveying screw 13*b*1 and the second conveying screw 13*b*2 (i.e., auger screws) serving as the conveyors, and a doctor blade 13*c*** serving as a developer regulator.

The developing roller **13*a* includes a cylindrical sleeve 13*a*2 made of a nonmagnetic material and rotates counterclockwise in FIG. 2** by a drive motor as a driver. The nonmagnetic material includes, but is not limited to, aluminum, stainless steel, brass, and conductive resin.

A casing of the developing device 13 has an opening so that the developing roller **13*a* is opposed to the photoconductor drum 11 in the development range R. In other words, when the developing device 13 is viewed alone, a part of the developing roller 13*a*** is exposed from the opening.

A magnet **13*a* 1 as a magnetic field generator is secured inside the sleeve 13*a*2 of the developing roller 13*a* to generate a magnetic field as illustrated in FIG. 3. The magnet (magnetic field generator) 13*a* 1 forms distribution of magnetic force exerted by a plurality of magnetic poles P1 to P5 (see FIG. 5) around a circumference of the sleeve 13*a*2. In other words, the developing roller 13*a* includes the magnetic poles P1 to P5 each having a peak of the normal magnetic force in a predetermined region in a predetermined direction of rotation of the developing roller 13*a* (hereinafter, referred to as the "rotation direction"). The magnetic poles P1 to P5 are disposed at a plurality of positions (five positions in the present embodiment) around the entire circumference of the developing roller 13*a*** in the rotation direction, respectively.

The developer G carried on the developing roller **13*a* is transported to the doctor blade 13*c*, serving as the developer regulator, as the developing roller 13*a* rotates in the predetermined direction of rotation (in the present embodiment, counterclockwise as indicated by arrow A1 in FIG. 2). An amount of developer G on the developing roller 13***a* is suitably adjusted by the doctor blade 13*c*, after which the developer G is transported to the development range R opposite the photoconductor drum 11 illustrated in FIG. 5. Then, toner T in the developer G is attracted to the latent image formed on the photoconductor drum 11 due to the effect of an electric field for development generated in the development range R.

Specifically, with reference to FIG. 5, it can be seen that the scooping pole P4 of the plurality of magnetic poles acts on the magnetic carrier C in the developer G, and thus the developer G contained in the supply path, in which the first conveying screw 13*b*1 is disposed, of the developing device 13 is partially scooped up on the developing roller 13*a*. A part of the developer G carried on the developing roller 13*a* is scraped off by the doctor blade 13*c* and returned to the supply path. The developer G passes through a doctor gap between the doctor blade 13*c* and the developing roller 13*a* where the pre-main pole P5 acts. Then, the grains of the developer G carried on the developing roller 13*a* stand on end on the developing roller 13*a* due to the magnetic force exerted by the main magnetic pole P1 of the plurality of magnetic poles, forming a magnetic brush in the development range R and slidingly contact the photoconductor drum 11. Thus, the toner T in the developer G carried on the developing roller 13*a* adheres to the latent image formed on the photoconductor drum 11. After passing through the development range R where the main magnetic pole P1 acts, the developer G passes between an upper cover 13*r* and the developing roller 13*a* by the magnetic force exerted by the conveyance poles P2 and P3 and is transported to a position corresponding to a developer release pole between the magnetic poles P3 and P4. Then, at the position corresponding to the developer release pole, magnetic repulsion to separate the developer G from the developing roller 13*a* acts on the carrier C, and the developer G carried on the developing roller 13*a* after the development process is removed from the developing roller 13*a*. Then, the developer G falls into the collection path of the developing device 13 and is transported downstream by the second conveying screw 13*b*2 therein.

With reference to FIG. 2, in the present embodiment, the doctor blade 13*c* as the developer regulator is a nonmagnetic plate disposed below the developing roller 13*a*. Alternatively, in another embodiment, a portion of the doctor blade 13*c* can be made of a magnetic material. The doctor blade 13*c* is opposed to the developing roller 13*a* below the developing roller 13*a*, serving as the developer regulator to adjust the amount of the developer G carried on the developing roller 13*a*.

In FIG. 2, the developing roller 13*a* rotates counterclockwise, and the photoconductor drum 11 rotates clockwise.

The first and second conveying screws 13*b*1 and 13*b*2 stir the developer G contained in the developing device 13 while circulating the developer G in the longitudinal direction of the developing device 13 (hereinafter also referred to as a "developer conveyance direction"), perpendicular to the surface of the paper on which FIG. 2 is drawn.

The first conveying screw 13*b*1 as the conveyor for supplying the developer G is opposed to the developing roller 13*a* and supplies the developer G to the developing roller 13*a* as indicated by blank arrows illustrated in the part (b) of FIG. 3 at the position corresponding to the scooping pole P4 while horizontally transporting the developer G in the developer conveyance direction to the left in the FIG. 3 as indicated by the broken-line arrow illustrated in the part (b) of FIG. 3. The first conveying screw 13*b*1 rotates counterclockwise in FIG. 2.

The second conveying screw 13*b*2 as the conveyor for collecting the developer G is disposed above the first conveying screw 13*b*1 and opposite the developing roller 13*a*. The second conveying screw 13*b*2 horizontally transports the developer G that has been forcibly separated from the developing roller 13*a* by the developer release pole in the direction indicated by blank arrows in the part (a) of FIG. 3 to the right in FIG. 3 as indicated by the broken-line arrow illustrated in the part (a) of FIG. 3. In the present embodiment, the second conveying screw 13*b*2 rotates in the direction opposite to the developing roller 13*a* (i.e., clockwise in FIG. 2).

As indicated by alternate long and short dashed arrows in FIG. 3, the developer G is transported from the downstream side of the supply path (hereinafter, also referred to as "a first transport path") in which the first conveying screw 13*b*1 is disposed, through a first communication opening 13*f*, and to the upstream side of the collection path (hereinafter, also referred to as "a second transport path") in which the second conveying screw 13*b*2 is disposed. Then, the second conveying screw 13*b*2 transports the developer G downstream in the collection path (the second transport path) and to the upstream side of the supply path (the first transport path) through a second communication opening 13*g*.

The first and second conveying screws 13*b*1 and 13*b*2 are disposed so that axes of rotation of the first and second conveying screws 13*b*1 and 13*b*2 are substantially horizontal similar to the developing roller 13*a* and the photoconductor drum 11. Each of the first and second conveying screws 13*b*1 and 13*b*2 includes a shaft and a helical blade wound around the shaft.

The first and second conveying screws 13*b*1 and 13*b*2 and the developing roller 13*a* constitute a drive system with a gear train and are driven to rotate by the drive motor as the driver. That is, a controller causes the drive motor to rotate the first and second conveying screws 13*b*1 and 13*b*2 along with the developing roller 13*a*.

An inner wall (a partition) 13*d* of the developing device 13 separates the first transport path (the supply path) in which the first conveying screw 13*b*1 is disposed and the second transport path (the collection path) in which the second conveying screw 13*b*2 is disposed.

With reference to FIGS. 3 and 4, it can be seen that the downstream side of the second transport path (the collection path), in which the second conveying screw 13*b*2 is disposed, communicates with the upstream side of the first transport path (the supply path), in which the first conveying screw 13*b*1 is disposed, via the second communication opening 13*g*. In the downstream end portion of the second transport path in which the second conveying screw 13*b*2 is disposed, the developer G falls through the second communication opening 13*g* to the upstream end portion of the first transport path.

With reference to FIGS. 3 and 4, it can be seen that the downstream side of the first transport path, in which the first conveying screw 13*b*1 is disposed, communicates with the upstream side of the second transport path, in which the second conveying screw 13*b*2 is disposed, via the first communication opening 13*f*. In the first transport path in which the first conveying screw 13*b*1 is disposed, the developer G that is not supplied to the developing roller 13*a* accumulates adjacent to the first communication opening 13*f* and then is transported or supplied via the first communication opening 13*f* to the upstream end portion of the second transport path in which the second conveying screw 13*b*2 is disposed.

It is to be noted that a paddle or a screw wound in the direction opposite to the helical blade of the first conveying screw 13*b*1 may be provided on the downstream portion of the first conveying screw 13*b*1 to facilitate conveyance of the developer G at the position corresponding to the first communication opening 13*f*, which is conveyance from the supply path to the collection path against gravity.

This configuration provides the circulation path through which the developer G is circulated in the longitudinal direction by the first and second conveying screws 13*b*1 and 13*b*2 in the developing device 13. That is, when the developing device 13 operates, the developer G contained therein flows in the developer conveyance direction indicated by the broken arrows illustrated in FIGS. 3, and 4. Separating the first transport path (the supply path), in which the first conveying screw 13*b*1 supplies the developer G to the developing roller 13*a*, from the second transport path (the collection path), to which the developer G is collected from the developing roller 13*a* by the second conveying screw 13*b*2, can reduce density unevenness of toner images formed on the photoconductor drum 11.

The magnetic sensor to detect the toner concentration in the developer G circulated in the developing device 13 is disposed in the second transport path (the collection path) in which the second conveying screw 13*b*2 is disposed. Based on the toner concentration detected by the magnetic sensor, the fresh toner T is supplied from the toner container 28 to the developing device 13 through the toner supply inlet 13*e* disposed near the first communication opening 13*f*.

Additionally, with reference to FIGS. 3 and 4, it can be seen that the toner supply inlet 13*e* is disposed above the upstream side of the second transport path, in which the second conveying screw 13*b*2 is disposed, away from the development range R, that is, disposed outside the area occupied by the developing roller 13*a* in the longitudinal direction. Since the toner supply inlet 13*e* is disposed near the first communication opening 13*f*, the developer G separated from the developing roller 13*a* falls on the supplied toner T, which has a small specific gravity, in the collection path, and the supplied toner T is sufficiently dispersed in and mixed with the developer G over a relatively extended period of time toward the downstream side of the collection path.

It is to be noted that the position of the toner supply inlet 13*e* is not limited to inside the collection path (the second transport path) in which the second conveying screw 13*b*2 is disposed but can be disposed above the upstream portion of the supply path, for example.

With reference to FIGS. 2 and 5, it can be seen that the developing device 13 according to the present embodiment includes the upper cover 13*r* as a cover to cover the developing roller 13*a* downstream from the development range R in the rotation direction of the developing roller 13*a*.

The upper cover 13*r* as the cover is provided to cover the upper side of the developing device 13 (a range including the upper side of the developing roller 13*a*). The upper cover 13*r* functions as the exterior or the casing of the developing device 13 together with a lower cover 13*u* to cover the lower side of the developing device 13. In the present embodiment, the upper cover 13*r* and the lower cover 13*u* are made of a resin material such as acrylonitrile butadiene styrene (ABS) or polycarbonate (PC).

In the present embodiment, the casing of the developing device 13 is divisible into the upper cover 13*r* and the lower cover 13*u*. However, the configuration of the casing of the developing device 13 is not limited to the above-described embodiments, and various types of configurations can be used.

With reference to FIG. 2, it can be seen that the upper cover 13*r* as the cover has the vent (an opening) 13*r*4 that enables air to flow inside and outside the developing device 13. The developing device 13 includes a filter 13*t* that covers the vent 13*r*4 of the upper cover (cover) 13*r* to collect toner and ventilate.

In other words, a flow path to vent the air from the inside to the outside of the developing device 13 is formed in the upper cover 13*r*. The filter 13*t* is installed in the upper cover 13*r* to cover a part of the flow path. The filter 13*t* electrostatically attracts and collects toner T and carrier C to allow only air to pass through.

Figure 6:
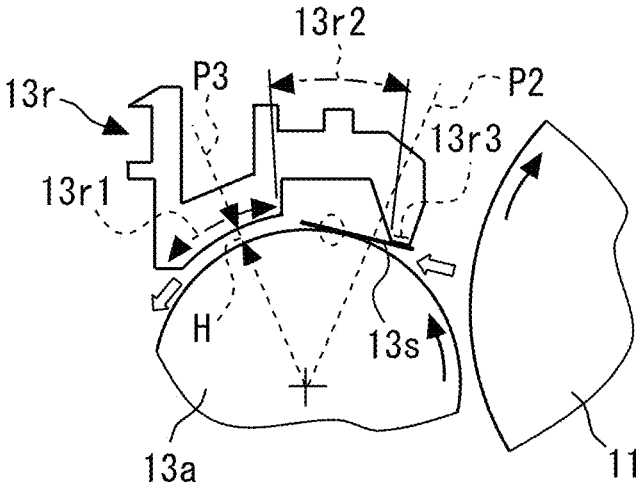
FIG. 6 is an enlarged view of a part of the developing device.

In a casing gap H (see FIG. 6) between the developing roller 13*a* and the upper cover 13*r*, the developer G carried on the developing roller 13*a* slidingly contacts the inner face of the upper cover 13*r*, and a suction airflow toward the interior of the developing device 13 is generated due to a pump action as indicated by the blank arrows in FIG. 6. As a result, toner scattering from the developing device 13 (which is scattering of toner to the periphery of the development range R) is less likely to occur because of the suction airflow.

However, the internal pressure of the developing device 13 is likely to increase due to the suction airflow, and if the internal pressure increases, toner scattering may occur from gaps of the developing device 13. On the other hand, in the present embodiment, since the vent 13*r*4 covered by the filter 13*t* is provided to collect the toner T, only air is vented while preventing the toner T from scattering to the outside. As a result, the increase of the internal pressure of the developing device 13 is minimized. That is, this configuration inhibits toner scattering caused by the increase of the internal pressure of the developing device 13.

The configuration and operation of the developing device 13 according to the present embodiment are described below.

As described above with reference to FIG. 2, the developing device 13 includes the upper cover 13*r* as the cover to cover the developing roller 13*a* downstream from the development range R in the rotation direction of the developing roller 13*a*.

Figure 7:
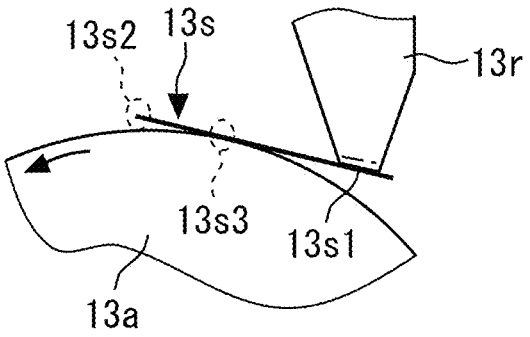
FIG. 7 is an enlarged view of a sheet member contacting the developing roller.

Furthermore, as illustrated in FIGS. 6 and 7, the developing device 13 according to the present embodiment includes a sheet member 13*s* cantilevered by the upper cover 13*r*. The sheet member 13*s* contacts the developing roller 13*a* with a flat face of the sheet member 13*s*, trailing along rotation of the developing roller 13*a*, downstream from the developing range R in the rotation direction.

Specifically, as illustrated in FIG. 7, the sheet member 13*s* is sheet-shaped and made of a flexible material such as polyurethane having a thickness of about 0.1 mm, and a root 13*s*1 of the sheet member 13*s* is adhered to the upper cover 13*r* with double-sided tape. The sheet member 13*s* is cantilevered by the upper cover 13*r* such that the root 13*s*1 is a secured end and a tip 13*s*2 of the sheet member 13*s* is a free end. Further, the free end tip 13*s*2 of the sheet member 13*s* is contactless with the developing roller 13*a*, but the flat face between the root (secured end) 13*s*1 and the free end tip 13*s*2 contacts the developing roller 13*a*, serving as a contact portion 13*s*3. The sheet member 13*s* contacts the developing roller 13*a* substantially in the entire range in the longitudinal direction of the developing roller 13*a* (at least in the range in which the developer G is carried in the longitudinal direction).

In the present embodiment, the length of the sheet member 13*s* is about 9 mm, and the length of the root 13*s*1 (sticking width) is about 3 mm in the lateral direction perpendicular to the longitudinal direction. The sheet member 13*s* contacts the developing roller 13*a*, inclining at about 15 degrees with respect to the horizontal plane.

As illustrated in FIG. 6, the upper cover 13*r* as the cover includes a large gap portion 13*r*2 and a small gap portion 13*r*1.

The large gap portion 13*r*2 forms a first gap (large gap) between the developing roller 13*a* and the upper cover 13*r* in a first predetermined range in the rotation direction indicated by the broken-line, double-headed arrow in FIG. 6. When the upper cover 13*r* is viewed from the developing roller 13*a*, the large gap portion 13*r*2 is concave in a trench shape. Therefore, the large gap portion 13*r*2 is disposed away from the developing roller 13*a* across the first gap larger than a second gap of a small gap portion 13*r*1 to be described later, thereby forming a space.

The small gap portion 13*r*1 is disposed adjacent to and downstream from the large gap portion 13*r*2 in the rotation direction (left side in FIG. 6). The small gap portion 13*r*1 forms a second gap (a small gap or the casing gap H) between the developing roller 13*a* and the upper cover 13*r* in a second predetermined range in the rotation direction indicated by the broken-line, double-headed arrow in FIG. 6. The second gap is substantially constant in the second predetermined range. The small gap portion 13*r*1 is provided in a substantially concentric arc shape with the outer circumferential face of the developing roller 13*a*. Accordingly, the substantially constant small gap (the casing gap H) is formed between the developing roller 13*a* and the small gap portion 13*r*1 in the rotation direction.

In the present embodiment, the first gap between the large gap portion 13*r*2 and the developing roller 13*a* is about 3 mm, and the second gap (the casing gap H) between the small gap portion 13*r*1 and the developing roller 13*a* is about 1 mm.

As described above, the developing device 13 according to the present embodiment includes the upper cover 13*r* including the small gap portion 13*r*1 and the large gap portion 13*r*2, and the sheet member 13*s* that contacts the developing roller 13*a* with the flat face of the sheet member 13*s*. As a result, toner scattering from the developing device 13 is substantially reduced.

Figure 8:
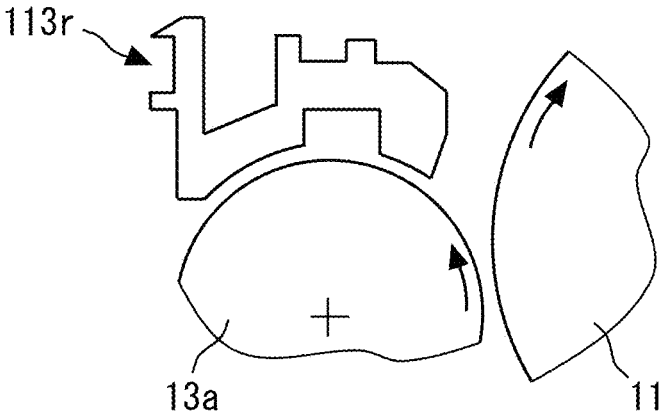
FIG. 8 is an enlarged view of a part of a developing device according to a comparative example.

Specifically, as described above, the suction airflow in the direction indicated by the blank arrows in FIG. 6 is formed in the gap between the developing roller 13*a* and the upper cover 13*r* due to the pump action. This suction airflow is generated by the developer G carried on the developing roller 13*a*, which slidingly contacts the upper cover 13*r* in the second gap (the casing gap H) between the developing roller 13*a* and the small gap portion 13*r*1. The first gap between the developing roller 13*a* and the large gap portion 13*r*2 is large enough to inhibit the developer G carried on the developing roller 13*a* from slidingly contacting the large gap portion 13*r*2 of the upper cover 13*r*. Therefore, the suction airflow in the direction indicated by the blank arrows in FIG. 6 is formed by the casing gap H between the developing roller 13*a* and the small gap portion 13*r*1. However, the casing gap H is not even in the longitudinal direction (perpendicular to the surface of the paper on which FIG. 6 is drawn), and a certain degree of deviation (variation) of the casing gap H occurs. In such a case, the suction airflow becomes weak where the casing gap H is large, and the suction airflow becomes strong where the casing gap H is small. As a result, toner is likely to blow backward in the direction opposite the blank arrows in FIG. 6 where the suction airflow is weak, causing toner scattering. That is, toner scatters through the opening, which forms the development range R, of the developing device 13 without the sheet member 13*s* like a comparative upper cover 113*r* illustrated in FIG. 8.

On the other hand, in the present embodiment, the sheet member 13*s* that contacts the developing roller 13*a* is disposed downstream from the development range R. Therefore, even if toner erupts together with air where the suction airflow is weak in the casing gap H between the developing roller 13*a* and the small gap portion 13*r*1, the sheet member 13*s* blocks the erupting toner and air, thereby preventing toner scattering outside the developing device 13.

In addition, even if air erupts where the suction airflow is weak, the erupting air stays in the space formed between the developing roller 13*a* and the large gap portion 13*r*2 while being blocked by the sheet member 13*s*. Then, the air is sucked through the casing gap H where the suction airflow is strong into the circulation path of the developing device 13. In other words, the space between the developing roller 13*a* and the large gap portion 13*r*2 functions as a buffer that cancels the unevenness of the strength of the suction airflow due to the deviation of the casing gap H in the longitudinal direction.

In the present embodiment, the upper cover 13*r* includes the small gap portion 13*r*1 and the large gap portion 13*r*2, and the sheet member 13*s* is provided for reducing the eruption of air and toner from the space formed by the large gap portion 13*r*2 to the outside of the developing device 13. Therefore, even if the casing gap H is uneven in the longitudinal direction, the suction airflow is formed satisfactorily, thereby preventing toner scattering through the opening, which forms the development range R, of the developing device 13.

In the present embodiment, the small gap portion 13*r*1 of the upper cover 13*r* causes the above-described suction airflow to be formed in the gap between the upper cover 13*r* and the developing roller 13*a*, thereby reducing toner scattering. In the case without the small gap portion 13*r*1 like another comparative upper cover 213*r* illustrated in FIG. 9, even if the sheet member 13*s* is provided, the suction airflow is not satisfactorily formed in the gap between the comparative upper cover 213*r* and the developing roller 13*a*, causing toner scattering.

Figure 9:
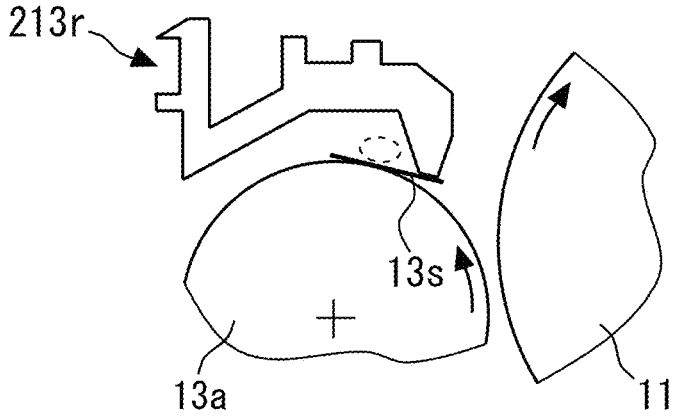
FIG. 9 is an enlarged view of a part of a developing device according to another comparative example.

Further, without the small gap portion 13*r*1 like the comparative upper cover 213*r* illustrated in FIG. 9, when the developing device 13 is removed from the image forming apparatus 1 and inclined, the developer G may flow backward and remain on the upper surface of the sheet member 13*s* surrounded by the broken-line circle in FIG. 9. As a result, if the developing process is restarted in such a state in which the developer G remains on the sheet member 13*s*, the sheet member 13*s* described above does not function satisfactorily.

In the present embodiment, since the sheet member 13*s* is cantilevered, the sheet member 13*s* does not strongly contact the developer G carried on the developing roller 13*a*, differing from the case in which the sheet member 13*s* is supported at both ends. Therefore, the sheet member 13*s* does not block the developer G. Further, since the sheet member 13*s* is cantilevered, even if the thickness of layer of the developer G carried on the developing roller 13*a* fluctuates or varies in the longitudinal direction, the state in which the sheet member 13*s* contacts the developing roller 13*a* is less likely to change.

Figure 10A:
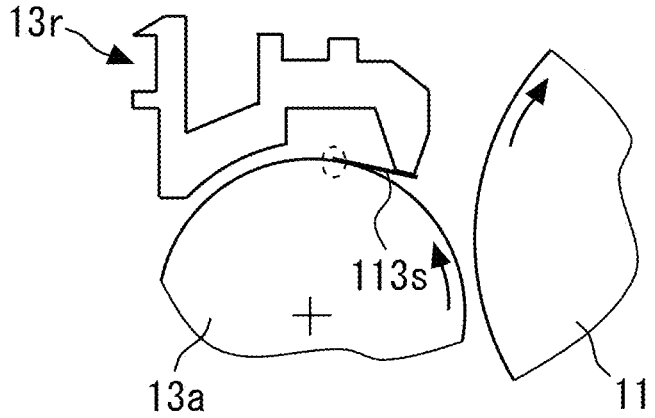
FIG. 10A is an enlarged view of a part of a developing device according to yet another comparative example.
Figure 10B:
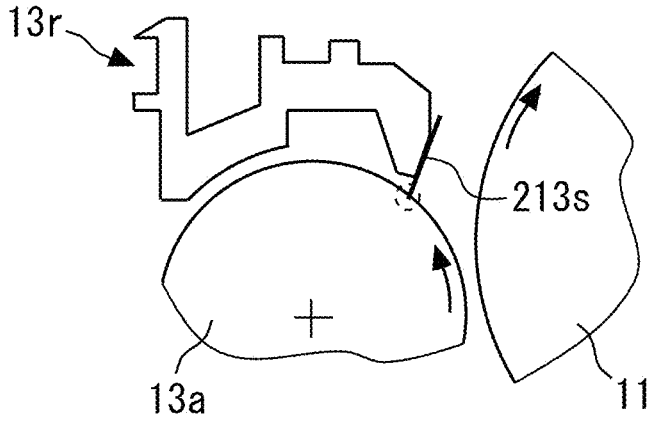
FIG. 10B is an enlarged view of a part of a developing device according to still yet another comparative example.

In the present embodiment, since the sheet member 13*s* contacts the developing roller 13*a* with the flat face of the sheet member 13*s*, the state in which the sheet member 13*s* contacts the developing roller 13*a* is less likely to change regardless of assembly tolerances or component tolerances, differing from the case in which the tips of comparative sheet members 113*s* and 213*s* contact the developing roller 13*a* as illustrated in FIGS. 10A and 10B. Further, since the sheet member 13*s* contacts the developing roller 13*a* with the flat face of the sheet member 13*s*, the sheet member 13*s* does not prevent the suction airflow from outside the developing device 13. As a result, the state in which the sheet member 13*s* contacts the developing roller 13*a* is less likely to change.

For all these reasons, the sheet member 13*s* stably exhibits the above-described functions.

As illustrated in FIG. 6, in the present embodiment, the sheet member 13*s* contacts the developing roller 13*a* with the flat face of the sheet member 13*s* at the position opposite the large gap portion 13*r*2.

That is, the contact portion 13*s*3 surrounded by the broken-line circle in FIG. 6 of the sheet member 13*s* is located at a position facing the large gap portion 13*r*2 (i.e., within the range where the large gap portion 13*r*2 is disposed).

With this configuration, the above-described functions of the sheet member 13*s* and the large gap portion 13*r*2 are stably exhibited. That is, even if air erupts where the suction airflow is weak in the casing gap H, the erupting air stays in the space formed between the developing roller 13*a* and the large gap portion 13*r*2 while being blocked by the sheet member 13*s*. Then, the air staying in the space is sucked through the casing gap H where the suction airflow is strong into the circulation path of the developing device 13.

As illustrated in FIG. 6, in the present embodiment, the small gap portion 13*r*1 of the upper cover 13*r* is opposed to the magnetic pole P3 that is one of the plurality of magnetic poles P1 to P5 of the developing roller 13*a* described above with reference to FIG. 5.

With this configuration, the grains of the developer G carried on the developing roller 13*a* stand on end on the developing roller 13*a* due to the magnetic force exerted by the magnetic pole P3, forming a magnetic brush slidingly contacting the small gap portion 13*r*1, so that the suction airflow by the pump action is reliably formed.

Further, as illustrated in FIG. 6, in the present embodiment, a portion of the sheet member 13*s* between the root (secured end) 13*s*1 supported by the cover 13*r* as the secured end and the free end tip 13*s*2 as the free end is opposed to the magnetic pole P2. The magnetic pole P2 is one of the plurality of magnetic poles P1 to P5 and different from the magnetic pole P3 opposite the small gap portion 13*r*1.

With this configuration, the developer G carried on the developing roller 13*a* stand on end on the developing roller 13*a* due to the magnetic force exerted by the magnetic pole P2, forming a magnetic brush slidingly contacting the sheet member 13*s*, so that the above-described functions of the sheet member 13*s* are stably exhibited. That is, even if air erupts from where the suction airflow is weak in the casing gap H, the sheet member 13*s* reliably blocks the erupting air.

Note that, in the present embodiment, the portion of the sheet member 13*s* between the root (secured end) 13*s*1 and the contact portion 13*s*3 is opposed to the magnetic pole P2. With this configuration, the above-described effects can be efficiently obtained while the suction airflow from outside the developing device is favorably formed. In particular, since a strong airflow is likely to be generated at the portion of the surface of the developing roller 13*a* corresponding to the magnetic pole P2, it is useful to make the sheet member 13*s* contact the portion of the developing roller corresponding to the magnetic pole P2.

In the present embodiment, as illustrated in FIG. 7, the free end tip 13*s*2 of the sheet member 13*s* as the free end does not contact the developing roller 13*a*. That is, the free end tip 13*s*2 of the sheet member 13*s* is floating without contacting the developing roller 13*a*.

With this configuration, regardless of assembly tolerances or component tolerances of the sheet member 13*s* or the upper cover 13*r*, the contact state of the sheet member 13*s* with the developing roller 13*a* is less likely to change. Further, even if the developing roller 13*a* is rotated in reverse during maintenance of the developing device 13, the free end tip 13*s*2 of the sheet member 13*s* is less likely to curl. For these reasons, the sheet member 13*s* stably exhibits the above-described functions.

In addition, as illustrated in FIGS. 6 and 7, in the present embodiment, a gap (space) in the rotation direction is formed between the free end tip 13s2 as the free end of the sheet member 13*s* and the small gap portion 13*r*1.

That is, the sheet member 13*s* does not extend to a boundary between the small gap portion 13*r*1 and the large gap portion 13*r*2, but the free end tip 13*s*2 of the sheet member 13*s* is disposed away from the boundary across the space. In other words, when the upper cover 13*r* is viewed from the developing roller 13*a* along the rotation direction of the developing roller 13*a*, the root (secured end) 13*s*1, the flat face, and the free end tip 13*s*2 of the sheet member 13*s*, the space formed by the large gap portion 13*r*2 without interposing the sheet member 13*s*, and the small gap portion 13*r*1 are arranged in the described order from upstream.

With this configuration, the above-described functions of the sheet member 13*s* and the large gap portion 13*r*2 are stably exhibited. That is, even if air erupts from where the suction airflow is weak in the casing gap H, the erupting air stays in the space formed between the developing roller 13*a* and the large gap portion 13*r*2 while being blocked by the sheet member 13*s*. Then, the air staying in the space is sucked through the casing gap H where the suction airflow is strong into the circulation path of the developing device 13. Further, the suction airflow from outside the developing device 13 is favorably formed. In addition, with the above-described positional relation, a wide space is formed on the back side of the sheet member 13*s* on the free end side, which is not opposed to the developing roller 13*a*. Accordingly, the passage of the airflow in the longitudinal direction is sufficient. Therefore, the suction airflow is less likely to vary in the longitudinal direction as compared with the case in which the secured end and the free end are arranged in reverse.

As illustrated in FIG. 6, in the present embodiment, the upper cover 13*r* includes an entrance gap portion 13*r* 3 in addition to the small gap portion 13*r*1 and the large gap portion 13*r*2. The entrance gap portion 13*r* 3 is disposed adjacent to and upstream from the large gap portion 13*r*2 in the rotation direction and a third gap between the upper cover 13*r* and the developing roller 13*a* progressively decreases in size from upstream to downstream in the rotation direction. That is, the third gap between the entrance gap portion 13*r* 3 of the upper cover 13*r* and the developing roller 13*a* is substantially wedge-shaped to better direct the air near the development range R between the developing roller 13*a* and the upper cover 13*r* along with the rotation of the developing roller 13*a*, thereby reliably forming the suction airflow in the direction indicated by the blank arrows in FIG. 6.

In addition, in the present embodiment, the sheet member 13*s* is attached to and cantilevered by the entrance gap portion 13*r* 3. With this configuration, the sheet member 13*s* reliably contacts the developing roller 13*a* with the flat face of the sheet member 13*s*, trailing along the rotation direction of the developing roller 13*a*.

As described above, the developing device 13 according to the present embodiment includes the upper cover 13*r* configured to cover the developing roller 13*a* downstream from the development range R in the rotation direction and the sheet member 13*s* cantilevered by the upper cover 13*r*. The sheet member 13*s* contacts the developing roller 13*a* with the flat face of the sheet member while trailing along the rotation direction at the position downstream from the development range in the rotation direction. The upper cover 13*r* includes the large gap portion 13*r*2 to form the first gap between the large gap portion 13*r*2 and the developing roller 13*a* in the first predetermined range in the rotation direction and the small gap portion 13*r*1 disposed adjacent to and downstream from the large gap portion 13*r*2 in the rotation direction to form the second gap (casing gap) H between the small gap portion 13*r*1 and the developing roller 13*a* in a second predetermined range in the rotation direction. The second gap is substantially constant in the second predetermined range in the rotation direction. The first gap is larger than the second gap, so toner scattering can be substantially reduced.

As a result, according to the present disclosure, a developing device, a process cartridge, and an image forming apparatus can be provided that minimizes toner scattering.

It is to be noted that, in the above-described embodiments, the second conveying screw 13*b*2 serving as a collection screw is disposed above the first conveying screw 13*b*1 serving as a supply screw, and the doctor blade 13*c* is disposed below the developing roller 13*a* in the two-component type developing device 13. However, the present disclosure can be applied to a developing device employing a two-component development method in which a second conveying screw serving as a collection screw is disposed below a first conveying screw serving as a supply screw, and a doctor blade is disposed above a developing roller, or another developing device employing the two-component development method in which a plurality of conveyors is horizontally arranged in parallel. Further, the present disclosure can be applied to yet another developing device employing a one-component development method using only toner without carrier as a developer.

In the above-described embodiments, the present disclosure is applied to the developing device 13 in which the developing roller 13*a* is disposed across a gap from the photoconductor drum 11 as the image bearer. Alternatively, the present disclosure can be applied to a developing device employing the contact type one-component development method, in which a developing roller is in contact with an image bearer.

In such configurations, effects similar to those described above are also attained.

Further, the present disclosure is applied to the developing device 13 that is separately installed in the image forming apparatus 1. However, the present disclosure is not limited to the above described configuration and can be applied to a developing device that is an integral part of a process cartridge together with other components. In this case, workability of maintenance of the image forming unit can be improved.

It is to be noted that the term "process cartridge" used in the present disclosure means a removable unit including an image bearer and at least one of a charging device to charge the image bearer, a developing device to develop latent images on the image bearer, and a cleaning device to clean the image bearer that are united together, and is designed to be removably installed as a united part in the image forming apparatus.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A developing device configured to develop latent images on a surface of an image bearer, the developing device comprising:

a developing roller configured to rotate in a predetermined direction of rotation and opposed to or in contact with the image bearer to form a development range;

a cover configured to cover the developing roller downstream from the development range in the predetermined direction of rotation, the cover including:

a first portion in which a minimum distance between the first portion of the cover and a center of the developing roller is a first distance; and a second portion in which the minimum distance between the second portion of the cover and the center of the developing roller is a second distance smaller than the first distance, the second portion of the cover disposed adjacent to and downstream from the first portion of the cover in the predetermined direction of rotation; and a sheet member cantilevered by the cover and configured to contact a developer on the developing roller with a flat face of the sheet member while trailing along the predetermined direction of rotation at a position downstream from the development range.

2. The developing device according to claim 1, wherein the sheet member is configured to contact the developer on the developing roller with the flat face of the sheet member at a position opposite the first portion of the cover.

3. The developing device according to claim 1, wherein the developing roller includes a magnetic field generator including a plurality of magnetic poles each having a peak of a normal magnetic force in a predetermined region around an entire circumference of the developing roller in the predetermined direction of rotation, and wherein the second portion of the cover is opposed to one of the plurality of magnetic poles.

4. The developing device according to claim 3, wherein the sheet member has a secured end supported by the cover and a free end tip, and wherein a portion of the sheet member between the secured end and the free end tip is opposed to another of the plurality of magnetic poles different from the one of the plurality of magnetic poles.

5. The developing device according to claim 1,
wherein a free end tip of the sheet member is contactless with the developer on the developing roller.

6. The developing device according to claim 1,
wherein a free end tip of the sheet member is disposed away from the second portion of the cover across a gap in the predetermined direction of rotation.

7. The developing device according to claim 1,
wherein the cover further includes a third portion disposed adjacent to and upstream from the first portion in the predetermined direction of rotation, a distance between the third portion of the cover and the developing roller progressively decreasing in size from upstream to downstream in the predetermined direction of rotation, and
wherein the sheet member is attached to and cantilevered by the third portion.

8. The developing device according to claim 1, further comprising:
a developer regulator disposed opposite and below the developing roller and configured to adjust an amount of the developer, and
wherein the cover is configured to cover an upper portion of the developing roller.

9. A process cartridge comprising:
the developing device according to claim 1; and
the image bearer,
wherein the process cartridge is removably installable in an image forming apparatus, and
wherein the developing device and the image bearer are integral parts of the process cartridge.

10. An image forming apparatus comprising:
the developing device according to claim 1; and
the image bearer.

11. The developing device according to claim 1, wherein the minimum distance between the second portion of the cover and the developing roller is the second distance smaller than the first distance such that only the second portion of the cover among the first portion and the second portion of the cover contacts the developer on the developer roller.

12. The developing device according to claim 1, wherein a contact between the second portion of the cover and the developer on the developer roller generates a suction force when the developing roller rotates.

13. A developing device configured to develop latent images on a surface of an image bearer, the developing device comprising:
a developing roller configured to rotate in a predetermined direction of rotation and opposed to or in contact with the image bearer to form a development range;
a cover configured to cover the developing roller downstream from the development range in the predetermined direction of rotation, the cover including:
a first portion in which a minimum distance between the first portion of the cover and the developing roller is a first distance; and
a second portion in which the minimum distance between the second portion of the cover and the developing roller is a second distance smaller than the first distance, the second portion of the cover disposed adjacent to and downstream from the first portion of the cover in the predetermined direction of rotation; and
a sheet member cantilevered by the cover and configured to contact a developer on the developing roller with a flat face of the sheet member at least in a range in which the developer is carried in a longitudinal direction.

* * * * *